US008629363B2

(12) United States Patent
Pohl et al.

(10) Patent No.: US 8,629,363 B2
(45) Date of Patent: Jan. 14, 2014

(54) ELECTRICAL SWITCH

(71) Applicant: Marquardt GmbH, Rietheim-Weilheim (DE)

(72) Inventors: Edgar Pohl, Stein am Rhein (CH); Klaus Fiederer, Durbheim (DE); Alfons Steidle, Spaichingen (DE); Emiliano Villanova, Neunkirch (CH)

(73) Assignee: Marquardt GmbH, Rietheim-Weilheim (DE)

( * ) Notice: Subject to any disclaimer, the term of this patent is extended or adjusted under 35 U.S.C. 154(b) by 0 days.

(21) Appl. No.: 13/656,974

(22) Filed: Oct. 22, 2012

(65) Prior Publication Data

US 2013/0043114 A1 Feb. 21, 2013

Related U.S. Application Data

(63) Continuation of application No. PCT/EP2011/002035, filed on Apr. 21, 2011.

(30) Foreign Application Priority Data

Apr. 21, 2010 (DE) ..... 10 2010 017 910

(51) Int. Cl.
*H01H 5/00* (2006.01)

(52) U.S. Cl.
USPC ..... 200/468

(58) Field of Classification Search
USPC ..... 200/468, 522, 520, 405, 17 R, 402, 553, 200/538, 537, 563, 339
See application file for complete search history.

(56) References Cited

U.S. PATENT DOCUMENTS

| | | | | |
|---|---|---|---|---|
| 6,469,268 | B1 | 10/2002 | Schaeffeler et al. | |
| 7,754,985 | B2 * | 7/2010 | Gordon et al. | 200/1 R |
| 8,410,387 | B2 * | 4/2013 | Niklewski et al. | 200/522 |
| 2003/0010617 | A1 | 1/2003 | Schaeffeler et al. | |
| 2004/0011636 | A1 * | 1/2004 | Sasaki et al. | 200/553 |
| 2004/0040827 | A1 | 3/2004 | Chu | |

FOREIGN PATENT DOCUMENTS

| | | | |
|---|---|---|---|
| DE | 19 98 147 | U | 12/1968 |
| DE | 35 12 665 | A1 | 10/1986 |
| DE | 199 30 558 | A1 | 1/2000 |
| EP | 1 315 186 | A1 | 5/2003 |
| WO | 01/54153 | A1 | 7/2001 |

OTHER PUBLICATIONS

International Search Report and Written Opinion dated Jul. 7, 2011.
German Search Report dated Dec. 20, 2012.

* cited by examiner

*Primary Examiner* — Edwin A. Leon
(74) *Attorney, Agent, or Firm* — Burr & Brown, PLLC

(57) ABSTRACT

An electrical switch having a contact system including at least one fixed contact and a switching contact. The switch has an actuating element for acting in switching fashion on the contact system and a switching slide which bears the switching contact and is moveable in a movement direction between two positions, wherein in one position the switching contact is remote from the fixed contact and in the other position the switching contact bears against the fixed contact. The switch has an actuating slide which is moveable by virtue of the actuating element and is coupled to the switching slide by an elastic element. The switch includes a latching mechanism which interacts with the switching slide, such that the switching slide can be switched over between the two positions on actuation of the actuating element with a type of snap-action movement.

10 Claims, 6 Drawing Sheets

Connections on one side
Docking via male connector block possible

Contact opening perpendicular to impact direction:

ELECTRICAL SWITCH

CROSS REFERENCE TO RELATED APPLICATIONS

This application is a continuation of International Application No. PCT/EP2011/002035 filed Apr. 21, 2011, which designated the United States, and claims the benefit under 35 USC §119(a)-(d) of German Application No. 10 2010 017 910.8 filed Apr. 21, 2010, the entireties of which are incorporated herein by reference.

FIELD OF THE INVENTION

The invention relates to an electrical switch.

BACKGROUND OF THE INVENTION

Such switches are used for electric appliances. In particular, these electric appliances are electric tools, for example handheld electric tools, such as electric drills, hammer drills, percussion hammers, chisel hammers, electric screwdrivers, angle grinders or the like, wherein these switches are often incorporated in the handle of the electric tool.

It has become apparent in the case of known switches for electric tools that the contact system can fail prematurely in the case of electric tools subjected to a high load. In particular, in such switches the switching and/or fixed contact for the contact system can be caused to fail when high-frequency opening and/or closing of the switching contact, for example owing to insufficient contact force and/or vibration, occurs. This negative effect, so-called teasing of the contact system, occurs in the case of low-voltage and also high-voltage applications in the AC and DC sector. In particular at relatively high voltages, for example at approximately 120 V, this negative effect is very pronounced owing to the high currents then flowing. Furthermore, teasing can also occur when the electric tool is operated under vibrations, i.e. for example in the percussion drilling mode or in the hammer mode.

DE 199 30 558 A1 discloses an electrical switch having a contact system comprising at least one fixed contact and a switching contact and having an actuating element for acting in switching fashion on the contact system. The switch has a switching slide, which bears the switching contact and is moveable in a movement direction between two positions, wherein in one position the switching contact is remote from the fixed contact and in the other position the switching contact bears against the fixed contact. An actuating slide which is moveable by virtue of the actuating element is coupled to the switching slide by means of an elastic means. Furthermore, a latching means interacts with the switching slide. As a result, the switching slide can be switched over between the two positions on actuation of the actuating element with a type of snap-action movement, whereby the switch provides good protection against teasing. This switch is therefore also suitable for high current applications at, for example, 120 V DC. The known switch, in which teasing is largely ruled out, has a large structure, however, and is therefore less suited to electric tools with a slender handle.

The invention is based on the problem of developing the switch such that said switch is suitable for use in slender handles of electric tools. In particular, a switch with an extra-slender switch profile is intended to be provided for application in mains-operated and/or rechargeable battery-operated hammer drills, percussion hammers and/or combination hammers which have a very slender spade handle, which is preferably impregnated with rubber for vibration damping.

SUMMARY OF THE INVENTION

This object is achieved in the case of an electrical switch of a generic type.

In the case of the switch according to the present invention, the actuating slide and the switching slide are arranged one behind the other in the movement direction and therefore in particular substantially in series with respect to the movement direction, whereby the switch has a very flat design. This provides in particular a switch, for example a hammer switch, with a tease-free switching system, with a slender switch housing and/or with electrical connections suitable for male connector blocks. Owing to the fact that all of the connections for the switch are located on the same side in the last mentioned case, the lines no longer need to be routed past the switch housing, which further contributes to the slender construction.

In order to provide a switch with a particularly simple configuration, the switching slide can be moveable substantially linearly in the movement direction. The actuating slide can likewise be moveable in the movement direction, to be precise in particular substantially linearly moveable.

Conventionally, the switch has a housing comprising, for example, a base and a cover. The actuating slide and the switching slide are then located in the housing, with said elements being mounted moveably in the housing. In order to promote the slender design, the fixed contact is located in series with the actuating slide and the switching slide with respect to the movement direction.

In a particularly compact design, the actuating slide has a U-shaped configuration, with the result that the switching slide is arranged in the actuating slide so as to be partially enclosed thereby. The elastic means can, at low cost, comprise a compression spring in the manner of an accelerating spring. In this case, one end of the accelerating spring can interact with the switching slide and the other end of the accelerating spring can interact with the actuating slide for switching over the switching slide between the two positions alternately, corresponding to the respective position of the switching slide. Furthermore, it is possible for a restoring spring acting between the actuating slide and a stop in the housing to be arranged in and/or on the actuating slide. The restoring spring serves to restore the actuating slide and thus also the sliding switch from one position to the other position. Preferably, the stop for the restoring spring is located in the base of the housing.

For reasons of good operability by the user, the actuating element can be arranged pivotably on the housing. In a compact design, it is then possible for a toggle lever mounted pivotably on the housing to be articulated both on the actuating element and on the actuating slide. With the aid of the toggle lever, the actuating slide is moveable substantially linearly in the movement direction by the pivoting movement of the actuating element.

Furthermore, in a simple configuration, the contact system can have two fixed contacts and one switching contact configured in the manner of a contact link. The contact link is arranged elastically on the switching slide by means of a contact spring.

Expediently, the fixed contact is arranged at one end on the housing, to be precise in particular perpendicularly. Usually, an electrical connection emerges from the fixed contact. Expediently, the connection is guided outwards at one end on the housing. Preferably, this applies for all connections, i.e.

both for the connection to the mains/rechargeable battery and for the motor connection. Since, therefore, the motor and mains lines are located on one side of the housing, a male connector block for the electrical feed lines for the "external" contact-making of the contact system can be plugged on at the connection in a simple manner.

With a compact and also inexpensive design, the latching means comprises a latching spring, in particular with an approximately U-shaped configuration, and a cam interacting with the latching spring. For the purpose of simple fitting, the latching spring can be arranged fixedly in the base. The cam can then be located on the switching slide, whereby the latching spring acts substantially "inwards" so as to promote the slender design. It is of course also possible for the latching spring to be arranged so as to act "outwards". Alternatively, the latching means can also comprise at least one spring-loaded sphere, instead of a latching spring, wherein in turn the sphere interacts with a corresponding cam.

As has already been mentioned, the electrical switch is suitable in particular for an electrical appliance, to be precise in particular for an electric tool which implements vibrations in an impact direction. Expediently, the switch is arranged in the electrical appliance in such a way that the movement direction is substantially perpendicular to the impact direction. In this installed position, teasing of the switch is largely prevented.

The following should be noted in respect of a particularly preferred embodiment with developments.

The arrangement for the switching system is configured in such a way that a very slender, elongate design is produced. This makes it possible to configure handles for the electric tool which are ergonomically and mechanically optimum. Slender handles with reinforcing ribs for reinforcement and a soft component for vibration damping are thus also possible. The switching system cannot be subject to teasing in the ON and/or OFF position owing to the snap-action switching characteristic. The switch is preferably incorporated in the electric tool in such a way that the contact opening is perpendicular to the impact direction of the machine, which represents the ideal case. Therefore, the risk of the contacts lifting owing to severe vibration is eliminated or at least reduced.

The connections are all intended to be on the same side in order to simplify fitting in the appliance and to enable the use of a male connector block. All of the electrical connections of the switch, namely the mains/rechargeable battery and motor connections, are located on one side; for example for flat plugs of 4.8 mm or 6.3 mm in width are used as connection. However, a corresponding switch can also be provided with pillar terminals, for example pillar terminals for the mains connection and flat plugs for the motor connection, or else a switch can be provided with screw terminals.

The switch can be produced with a monostable or bistable embodiment. In this case, the terms have the following meanings:

monostable:

When the actuator is released, the switch returns automatically to the OFF position, i.e. it is a "momentary contact switch"/"deadman switch".

bistable:

When switched on, the switch remains in the ON position and, when switched off, it remains in the OFF position, i.e. it is a "rocker switch" with "latching"/"locking".

Such a switch can therefore be provided with a rocker for a bistable switch.

The advantages achieved by the invention consist in particular in that the switch has small dimensions given a high electrical power capacity. The machine manufacturers for the electric tool can therefore configure the grip plate to be slender, robust and/or ergonomic. This is thanks to the extra-slender switch profile and/or also the type of connection for the switch. This results in improved possibilities for reinforcing ribs or two-component (2C) grip plates with soft components for vibration damping in the grip plate. The switching system cannot be subject to tease owing to the snap-action switching characteristic thereof. This is supported by the arrangement of the switch with its contact opening perpendicular to the impact direction, which represents the main vibration direction. Connection by means of a male connector block is possible since all of the connections are on one side. As a result, the lines for the voltage supply and/or voltage discharge do not need to be guided past the housing of the switch, which makes a slender profile for the switch possible.

BRIEF DESCRIPTION OF THE DRAWINGS

Exemplary embodiments of the invention with various developments and configurations are illustrated in the drawings and will be described in more detail below.

DETAILED DESCRIPTION OF THE INVENTION

Figure 1:
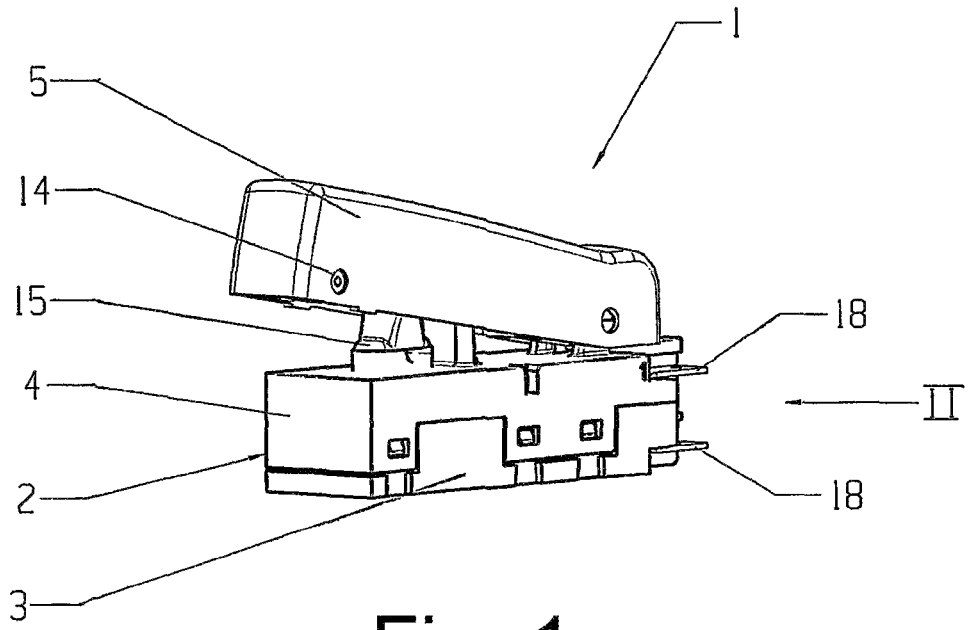
FIG. 1 shows an electrical switch for an electric tool in a perspective view.

FIG. 1 shows an electrical switch 1 with a monostable embodiment for electric tools, such as drills, hammer drills, percussion hammers, chisel hammers, angle grinders or the like. The switch 1 has a housing 2 comprising a base 3 and a cover 4. An actuating element 5 is mounted rotatably and therefore pivotably on the upper side of the housing 2. The actuating element 5 has a switching effect on a contact system 6 located in the housing 2 (see FIG. 3).

Figure 3:
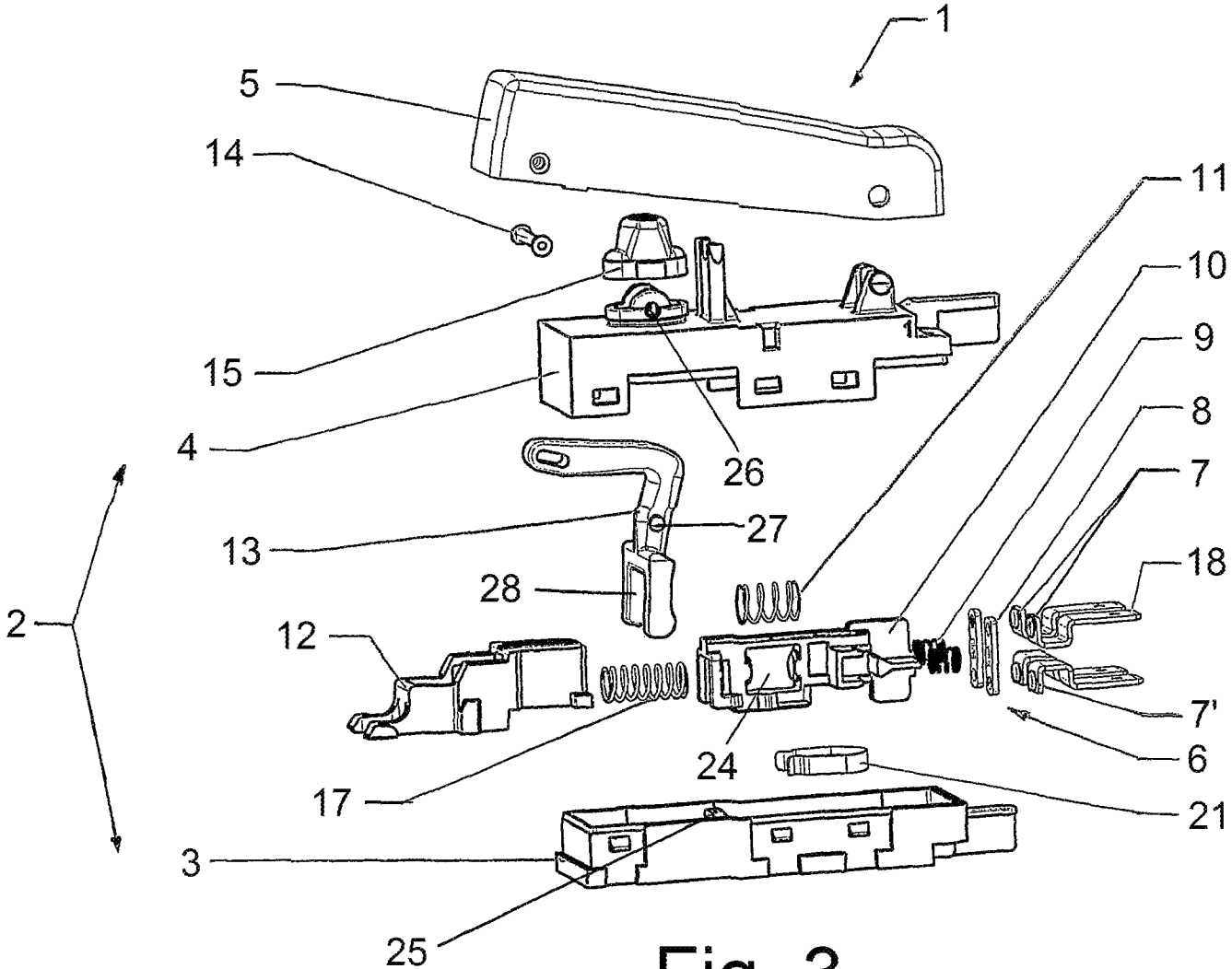
FIG. 3 shows the switch shown in FIG. 1 in an exploded illustration.

As can be seen in more detail in FIG. 3, the contact system 6 comprises at least one fixed contact 7 and one switching contact 8. In this case, the switching contact 8 is configured in the manner of a contact link and interacts with two fixed contacts 7, 7'. The switching contact 8 is borne by a switching slide 10, moveable between two positions, by virtue of the contact link 8 being arranged on the switching slide 10 by means of a contact spring 9. In one position, the switching contact 8 is remote from the fixed contact 7, 7', with this being the OFF switching position, and in the other position the switching contact 8 bears against the fixed contact 7, 7' which is the ON switching position. In this case, the two-poled contact system 6 also comprises a second contact link 8, which in turn interacts with two fixed contacts 7, 7'.

The switching slide 10 is coupled to an actuating slide 12 by means of an elastic means 11, namely a compression spring in the manner of an accelerating spring 11. The accelerating spring 11 is arranged in a frame-like cutout 24 in the switching slide 10. As a result, one end of the accelerating spring 11 can interact with the switching slide 10 and the other end of the accelerating spring 11 can interact with the actuating slide 12 for switching over the switching slide 10 alternately corresponding to the respective position of the switching slide 10.

Furthermore, a restoring spring 17 arranged in the actuating slide 12 acts between a stop 25 in the base 3 of the housing 2 and the actuating slide 12. The actuating slide 12 is for its part moveable by virtue of the actuating element 5 by virtue of the actuating slide 12 being coupled to the actuating element 5 by means of a toggle lever 13. The toggle lever 13 is mounted rotatably by means of a pin 27 on a pivot bearing 26 on the cover 4 of the housing 2. Firstly, the toggle lever 13 is articulated on the actuating element 5 by means of a tubular rivet 14 and, sealed off by a bellows-like seal 15, reaches into the housing 2. Secondly, the toggle lever 13 is articulated with the aid of fork-like tongs 28 on the actuating slide 12.

Figure 10:
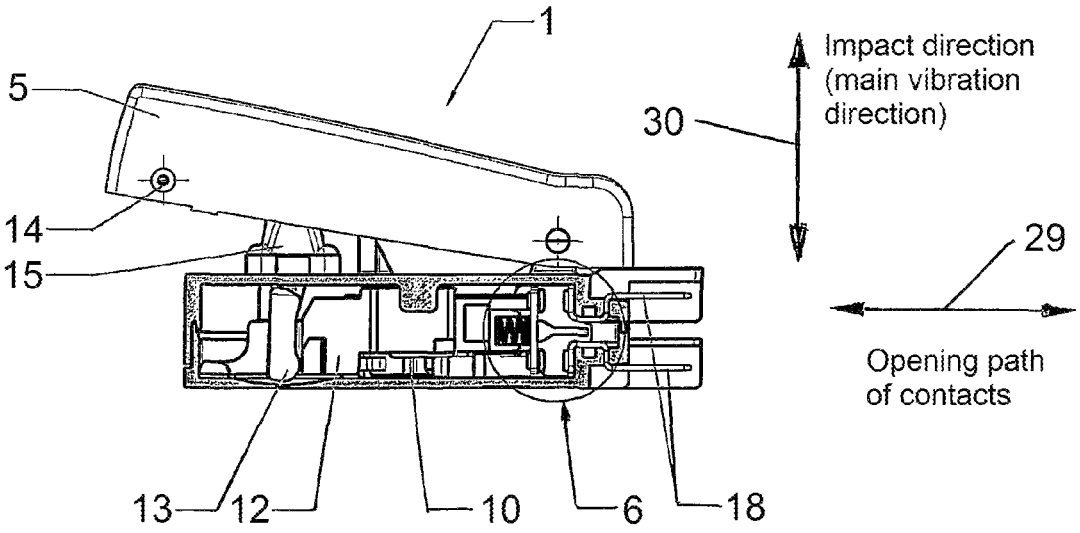
FIG. 10 shows the preferred installed arrangement of the switch in an electric tool.

As can be seen from FIG. 10, the actuating slide 12 is moveable substantially linearly in the movement direction 29 owing to the pivoting movement of the actuating element 5 via the toggle lever 13. The switching slide 10, which is coupled to the actuating slide 12 via the actuating spring 11, is likewise moveable substantially linearly in the movement direction 29. In this case, a latching means 16 (see FIG. 5) interacts with the switching slide 10 such that the switching slide 10 can be switched over between the two positions on actuation of the actuating element 5 with a type of snap-action movement.

Figure 4:
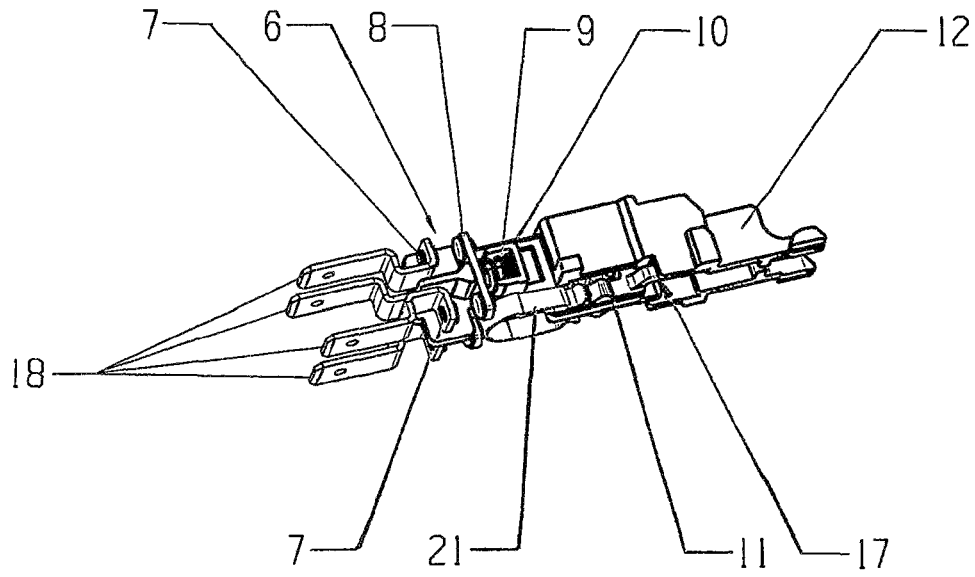
FIG. 4 shows the arrangement of individual parts in the switch in a perspective view.
Figure 6:
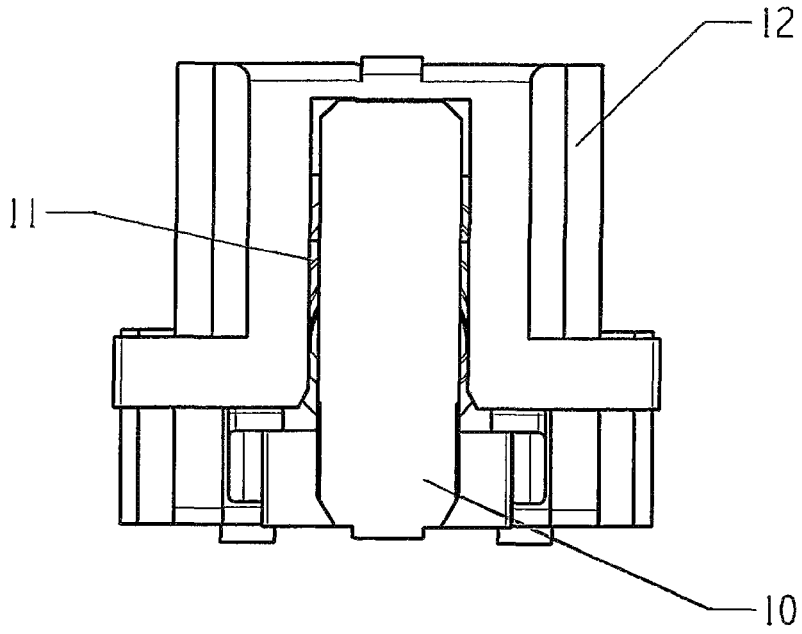
FIG. 6 shows the front view along arrow VI in FIG. 5.

The actuating slide 12 and the switching slide 10 are arranged one behind the other in the movement direction 29, to be precise substantially in series with respect to the movement direction 29, with the result that the switch 1 has a very flat design. In order to keep the size of the switch 1 small also in terms of length, the actuating slide 12 has a U-shaped configuration, as can be seen from FIGS. 4-6, with the result that the switching slide 10 is arranged in the actuating slide 12 in such a way that the switching slide 10 is partially enclosed by the actuating slide 12. The actuating slide 12 and the switching slide 10 are located in the housing 2, to be precise mounted linearly moveably in the base 3. Furthermore, the fixed contact 7, 7' is also located in series with the actuating slide 12 and with the switching slide 10 in the movement direction 29.

Figure 2:
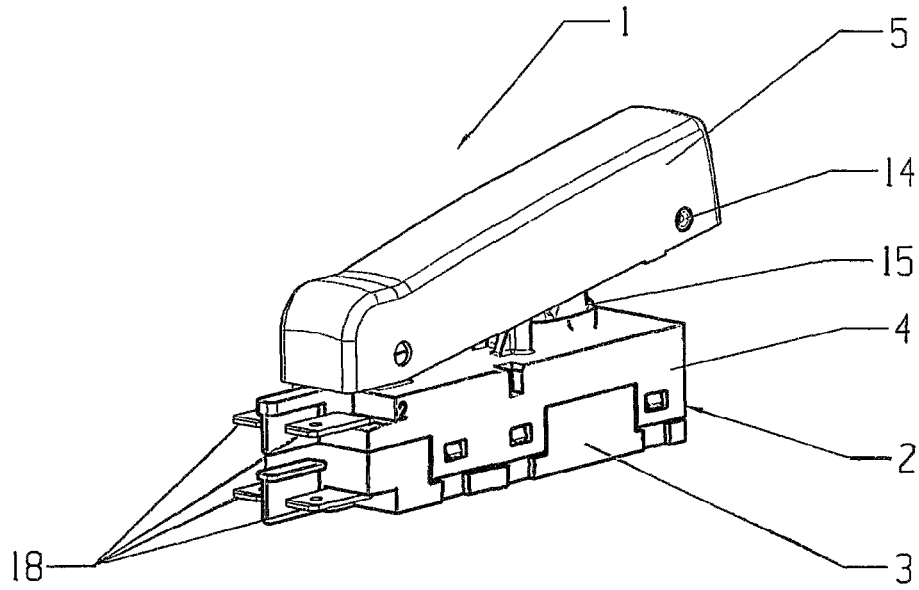
FIG. 2 shows the switch viewed from direction II in FIG. 1.
Figure 7:
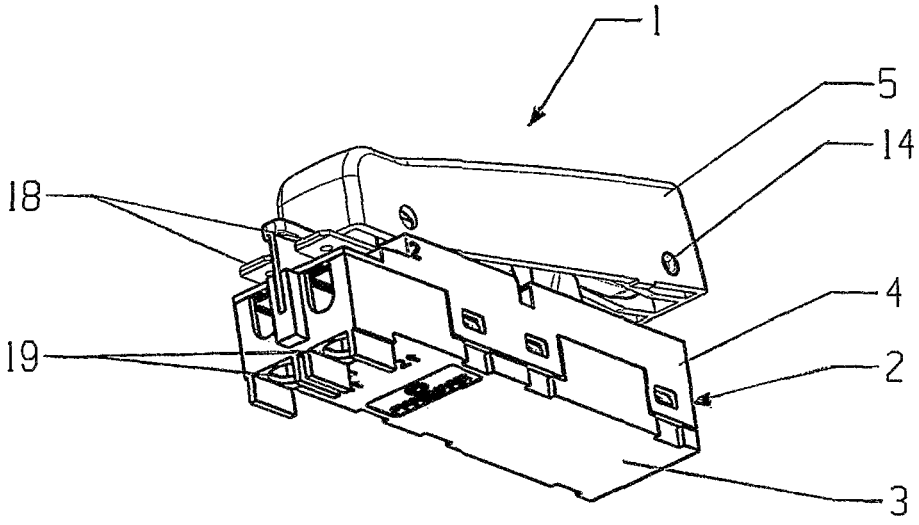
FIG. 7 shows a switch in accordance with a further embodiment in a perspective view.
Figure 8:
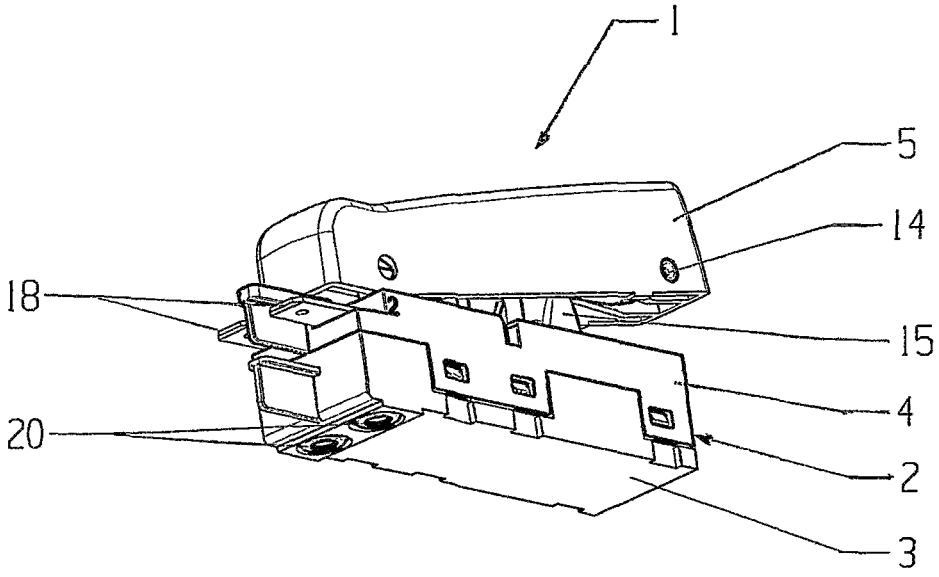
FIG. 8 shows a switch in accordance with yet a further embodiment in a perspective view.

As is finally also shown in FIG. 3, the fixed contact 7, 7' is arranged at one end on the housing 2, wherein an electrical connection 18 emerges from the fixed contact 7, 7'. The connection 18 leads outwards at one end on the housing 2 in the manner of a flat plug, as can be seen from FIG. 2. As a result, a male connector block for all of the electrical feed lines to the switch 1 can be plugged on in the manner of "external" contact making at the connections 18. In FIG. 7, in another embodiment, the mains connection for the switch 1 is realized by pillar terminals 19, while the motor connection at the switch 1 in turn comprises flat plugs 18. In the embodiment shown in FIG. 8, in turn the mains connection comprises screw terminals 20.

Figure 9:
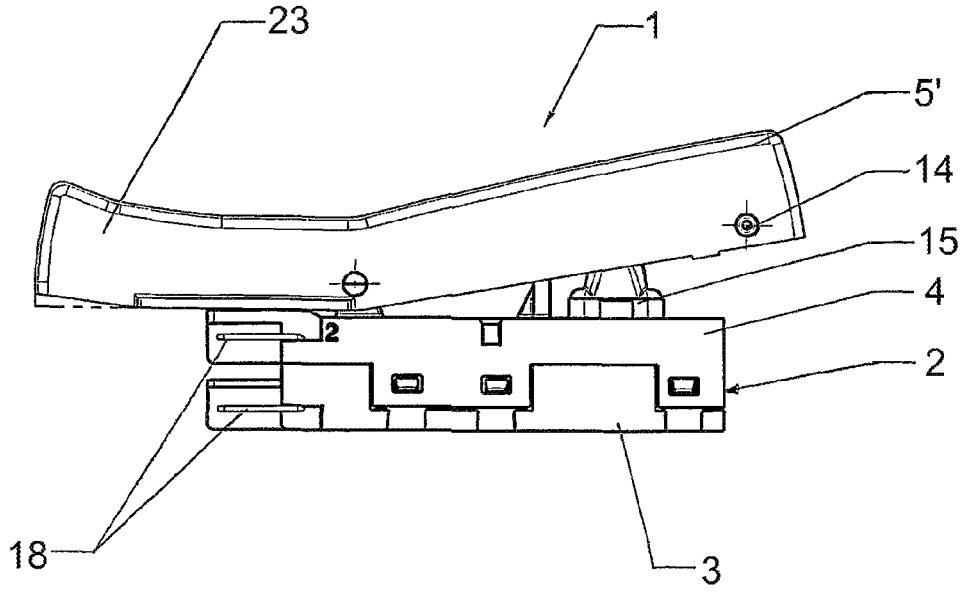
FIG. 9 shows a switch in accordance with another embodiment in a perspective view.

While the switching function of the switch shown in FIG. 1 has monostable configuration, i.e. the actuating element 5 returns automatically to the OFF switching position once it has been released by the operator owing to the action of the restoring spring 17, the embodiment shown in FIG. 9 shows a switch 1 with a bistable switching function. In the case of this bistable switch 1, in which the actuating element comprises a correspondingly configured rocker 5', the rocker 5' also remains in the ON switching position once it has been released by the operator. The rocker 5' has a region 23 for manual switchback by the operator to the OFF switching position.

Figure 5:
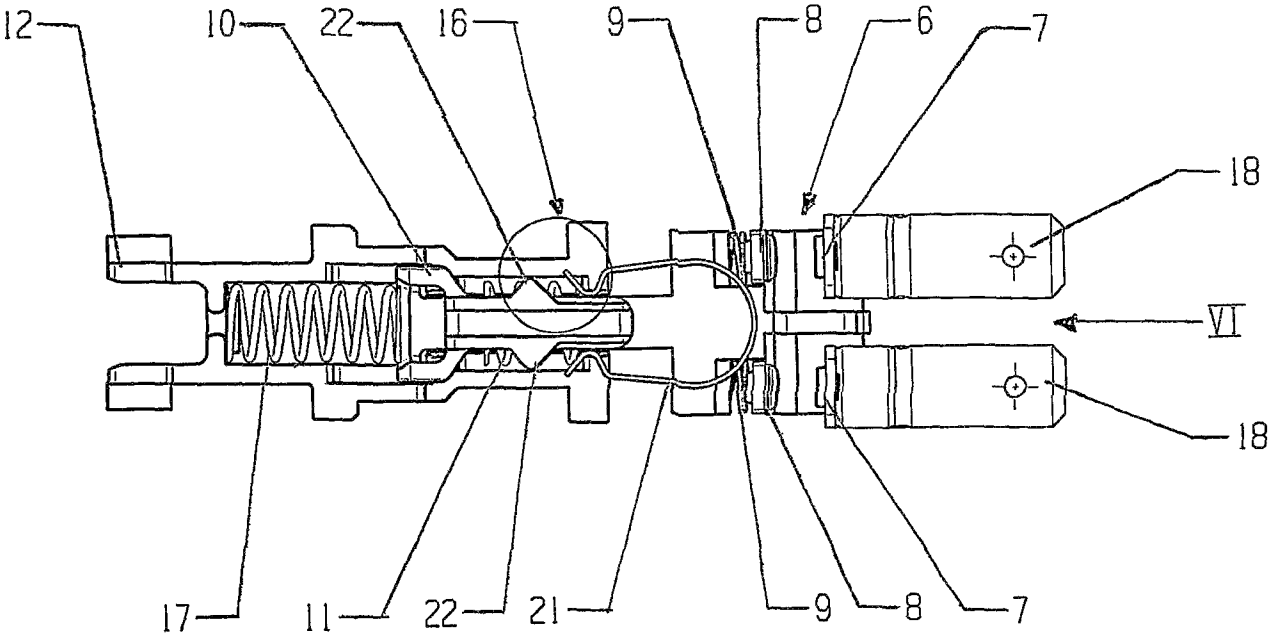
FIG. 5 shows the view from below of the arrangement shown in FIG. 4.

As can be seen in FIG. 5, the latching means 16 comprises a latching spring 21 and a cam 22 interacting with the latching spring 21. The latching spring 21 has an approximately U-shaped configuration and is arranged fixedly in the base 3. The cam 22 is located on the switching slide 10. Since the action of the latching spring 21 owing to this arrangement is directed inwards, this measure can also make a further contribution to the slender design of the housing 2. Alternatively, the latching means can also comprise at least one spring-loaded sphere and a cam interacting with the sphere, but this is not shown in any more detail.

Finally, FIG. 10 shows, in principle, the preferred installed arrangement of the switch 1 in the electric tool. The installation should take place such that the contact opening of the contact system 6, i.e. the opening path running in the movement direction 29 for the contacts 7, 7', 8, is directed substantially perpendicular to the impact direction 30 of the electric tool, which represents the main vibration direction for the electric tool.

The invention is not restricted to the exemplary embodiment described and illustrated. Instead, it includes all developments open to a person skilled in the art within the scope of the invention defined by the patent claims. Thus, such an electrical switch can be used not only in mains-operated and/or rechargeable battery-operated electric tools with percussive, hammering, vibrating or the like operation, but also in other electrical appliances supplied by a voltage source, such as gardening appliances, cooking appliances or the like. Advantageously, when using this switch, the reliability and operational safety of the corresponding electrical appliance is also increased in harsh use conditions and under high loads.

LIST OF REFERENCE SYMBOLS

1: (Electrical) switch
2: Housing
3: Base
4: Cover
5: Actuating element
5': Rocker
6: Contact system
7: Fixed contact/contact
7': Fixed contact/contact
8: Switching contact/contact link/contact
9: Contact spring
10: Switching slide
11: Electrical means/accelerating spring
12: Actuating slide
13: Toggle lever
14: Tubular rivet
15: Seal
16: Latching means
17: Restoring spring
18: (Electrical) connection/flat plug
19: Pillar terminal
20: Screw terminal
21: Latching spring (of latching means)
22: Cam (of latching means)
23: Region (on rocker)
24: Cutout (in switching slide)
25: Stop (in housing)
26: Pivot bearing
27: Pin
28: Fork

29: Movement direction
30: Impact direction

We claim:

1. An electrical switch having a contact system comprising at least one fixed contact and a switching contact, having an actuating element for acting in switching fashion on the contact system, having a switching slide, which bears the switching contact and is moveable in a movement direction between two positions, wherein in one position the switching contact is remote from the fixed contact and in the other position the switching contact bears against the fixed contact, having an actuating slide, which is moveable by virtue of the actuating element and is coupled to the switching slide by an elastic element, and having a latching mechanism interacting with the switching slide, such that the switching slide can be switched over between the two positions on actuation of the actuating element with a snap-action movement, wherein the actuating slide and the switching slide are arranged one behind the other in a row with respect to the movement direction.

2. The electrical switch as claimed in claim 1, wherein the switching slide is moveable substantially linearly in the movement direction, and wherein the actuating slide is moveable substantially linearly in the movement direction.

3. The electrical switch as claimed in claim 1, wherein the switch has a housing comprising a base and a cover, wherein the actuating slide and the switching slide are mounted moveably in the housing, and wherein the fixed contact is located in series with the actuating slide and switching slide in the movement direction.

4. The electrical switch as claimed in claim 1, wherein the actuating slide has a U-shaped configuration, with the result that the switching slide is arranged so as to be partially enclosed in the actuating slide, wherein the elastic element comprises a compression spring in the manner of an accelerating spring, wherein in particular alternately corresponding to the respective position of the switching slide, one end of the accelerating spring interacts with the switching slide and the other end of the accelerating spring interacts with the actuating slide for switching over the switching slide, and a restoring spring, which acts between the actuating slide and a stop in the housing, is arranged in or on the actuating slide for restoring the switching slide from one position to the other position.

5. The electrical switch as claimed in claim 1, wherein the actuating element is arranged pivotably on the housing, and a toggle lever mounted pivotably on the housing is articulated both on the actuating element and on the actuating slide, such that the actuating slide is moveable substantially linearly in the movement direction by the pivoting movement of the actuating element.

6. The electrical switch as claimed in claim 1, wherein the contact system has two fixed contacts and a switching contact configured in the manner of a contact link, and the contact link is arranged elastically on the switching slide by means of a contact spring.

7. The electrical switch as claimed in claim 1, wherein the fixed contact is arranged at one end on the housing, and an electrical connection emerges from the fixed contact and passes outwards at one end on the housing, such that a male connector block for the electrical feedlines can be plugged on at the connection.

8. The electrical switch as claimed in claim 1, wherein the latching mechanism comprises a latching spring with an approximately U-shaped configuration and a cam interacting with the latching spring, and the latching spring is arranged fixedly in the base, and the cam is located on the switching slide.

9. The electrical switch as claimed in claim 1, wherein the latching mechanism comprises at least one spring-loaded sphere and a cam interacting with the sphere.

10. An electrical appliance which implements vibrations in an impact direction, having an electrical switch as claimed in claim 1, wherein the switch is arranged in the electrical appliance in such a way that the movement direction is substantially perpendicular to the impact direction.

* * * * *